United States Patent [19]

Bouteille et al.

[11] Patent Number: 4,492,149

[45] Date of Patent: Jan. 8, 1985

[54] PRESSURE RELAY ADAPTED TO SIGNAL THE POSITION OF THE MOVABLE MEMBER OF A JACK

[75] Inventors: Daniel Bouteille, Ville d'Avray; Eric Petrimaux, Huest; Jean-Luc Burban, Maisons Laffitte, all of France

[73] Assignee: Legris, Rennes, France

[21] Appl. No.: 525,256

[22] Filed: Aug. 19, 1983

Related U.S. Application Data

[63] Continuation of Ser. No. 263,992, May 15, 1981, abandoned.

[30] Foreign Application Priority Data

May 23, 1980 [FR] France ..... 80 11560

[51] Int. Cl.[3] ..... F01B 31/12

[52] U.S. Cl. ..... 92/5 R; 137/625.66; 137/557

[58] Field of Search ..... 137/625.66, 580, 227, 137/557, 625.5, 85; 92/5 R; 91/1

[56] References Cited

U.S. PATENT DOCUMENTS

| | | | |
|---|---|---|---|
| 1,482,517 | 2/1924 | Kelsey | 137/227 X |
| 1,668,753 | 5/1928 | Baker | 137/227 X |
| 2,892,608 | 6/1959 | Collins | 137/625.5 X |
| 3,648,568 | 3/1972 | Wright | 92/5 R |

FOREIGN PATENT DOCUMENTS

| | | | |
|---|---|---|---|
| 955384 | 1/1957 | Fed. Rep. of Germany | 137/227 |
| 2343218 | 3/1976 | France . | |
| 2343280 | 3/1976 | France . | |
| 2352188 | 5/1976 | France . | |

*Primary Examiner*—Alan Cohan

*Attorney, Agent, or Firm*—Brooks Haidt Haffner & Delahunty

[57] ABSTRACT

The invention relates to a pressure relay comprising inside its body, and besides a distributor device with a pressure inlet, an outlet and an exhaust, an auxiliary conduit of large cross-section which is connected with a control input of the said distributor device and comprises means to mount the said body on the jack, and to receive a pipe fitting supplying pressure to a jack.

The invention finds an application for signalling the outermost positions of a jack piston, or in combination with branch-pipe type jacks.

12 Claims, 5 Drawing Figures

Figure 1:
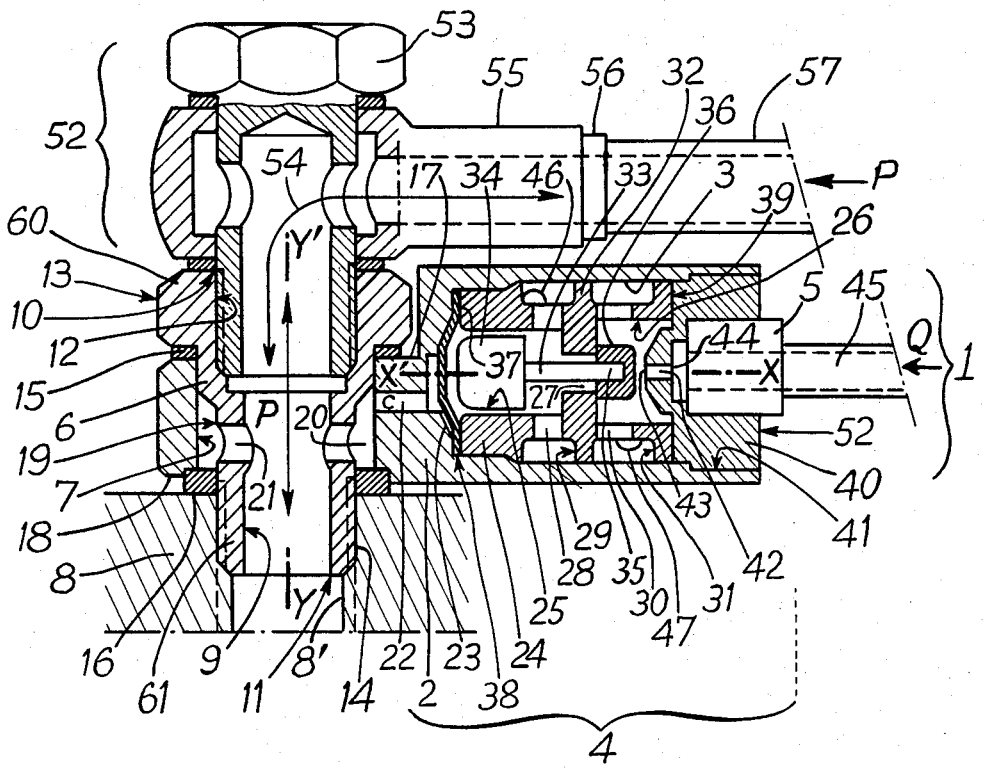

Fig. 3
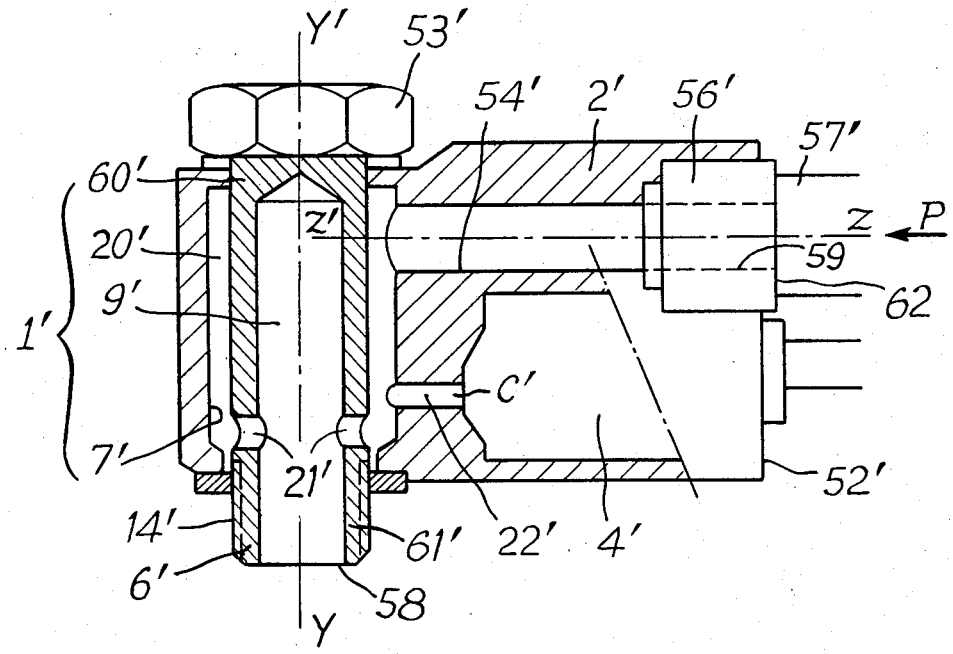
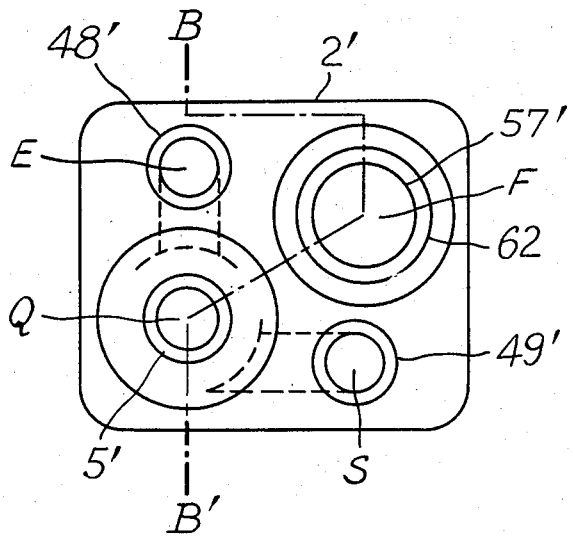
Fig. 4

PRESSURE RELAY ADAPTED TO SIGNAL THE POSITION OF THE MOVABLE MEMBER OF A JACK

This application is a continuation of application Ser. No. 263,992, filed May 15, 1981 now abandoned.

The invention relates to a pressure relay comprising, on the one hand, a supply inlet for a first fluid under pressure, an exhaust, an outlet and a control input, and on the other hand, and inside its body, distributor means with a switching member, such as a valve, which is adapted to connect the outlet, via conduits and internal orifices, either with the pressure inlet or with the exhaust, when a pneumatic control signal is applied to the said control input.

Such a relay, which is well known per se, finds an application for example in circuits controlling the position of the movable member of a jack wherein the control signals are represented by the pressure existing in the jack chamber the volume of which is reducing, which pressure becomes nil when the piston has effectively reached its end-of-stroke outermost position; such a relay is therefore a pressure-dropping relay.

When the said known relay was used in a circuit such as that mentioned hereinabove, it was normal to place it either inside a cabinet containing other pneumatic components, or on a mounting-plate fitted close to the jack to which it was associated. This form of installation presents all the problems that can result from the great lengths of tubing needed in such cases, i.e. the risk of their being damaged, the losses of load, or transmission delays, and some of the oil used to lubricate the jacks accummulating and preventing the instant transmission of the control signals by standing in the corresponding tubings. These disadvantages are further increased if the relay supply inlet also has to be connected to a conditional pressure intake situated in a special point of the jack cylinder in order to signal the passage of the piston in that point, or else if the jack supply circuit is fitted with a pneumatic speed regulator, as it is necessary in both these cases to use an intermediate connection to join up the said speed regulator, pressure relay and jack.

It is therefore the object of the invention to propose a pressure relay whose internal constitution corresponds to that indicated hereinabove, but where arrangements will be made for it to be connected directly to a jack; in this case, the most advantageous yields will be obtained when the relay supply inlet is connected to a pressure intake placed under the jack, or when a speed regulator is added to the supply of the jack.

This object is reached according to the invention due to the fact that the body of the relay is provided with an auxiliary conduit of large cross-section, a first end of which comprises first mechanical and pneumatic connecting means, which cooperate directly with a jack supply inlet, whilst a second end comprises second mechanical and connecting means adapted to receive a pipe supplying the jack with a second pressurized fluid, the control input of the distributor device being connected to the said auxiliary conduit between the said ends.

A pneumatic relay is also known from German Pat. No. 1 119 615, which comprises a valve adapted to stop and allow the flow of a fluid, in relation to a control pressure, and wherein the body of said relay is provided with a conduit of large cross-section, one end of which comprises first connecting means cooperating directly with a jack supply inlet, whereas the other end comprises second connection means adapted to receive the end of a jack supply pipe; in this known relay, however, there is no junction between the said conduit and the control signal input, and the aim here, which is to lock a jack in the event of pipe breakage, has nothing in common with the object of the present invention.

Figure 2:
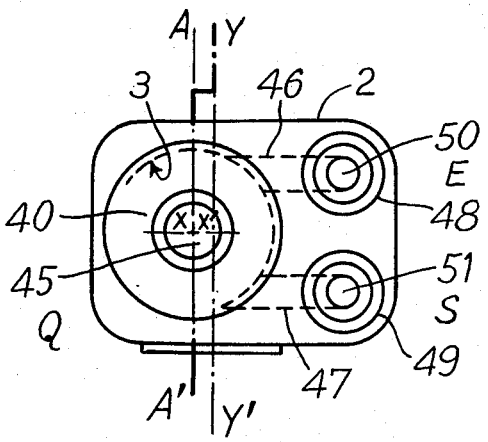

The invention will be more readily understood on reading the following description with reference to the accompanying drawings, in which:

FIG. 1 is a longitudinal cross-section along AA', showing a pressure relay adapted to cooperate directly with a fitting normally used to supply jacks, FIG. 2 is a view of the relay shown in FIG. 1, seen from the righthand side without the jack supply fitting, FIG. 3 is a longitudinal cross-section in two different planes along BB', of a pressure relay combined with a connection member similar to that of a fitting with a jack supply pipe, FIG. 4 is a view of the relay according to FIG. 3, seen from the righthand side.

Figure 5:
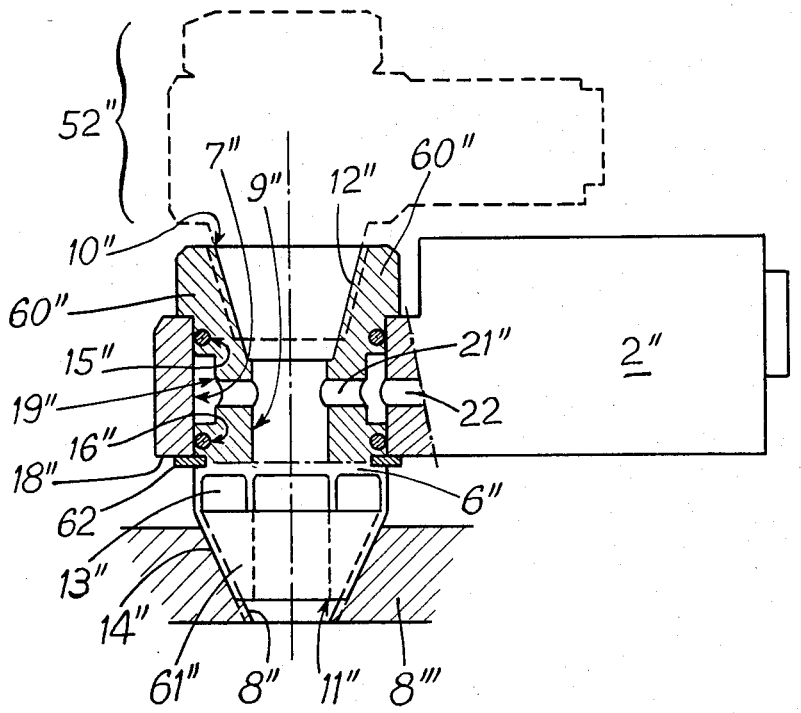

FIG. 5 is a longitudinal cross-section showing part of a relay adapted to be fitted in jack inlets with conical threads, and to be screwed by means of a clamping head with a different position than in the preceding illustrations.

FIG. 1 shows a pneumatic relay (1) which comprises a body (2) in which are provided, on the one hand, a first bore (3) of axis XX', designed to receive a pneumatic distributor device, generally designated by (4), associated to a pneumatic connector (5), and on the other hand, a second bore (7) of axis YY', substantially perpendicular to XX' in said Figure, and designed to receive a member (6) of general cylindrical hollow shape, which is used to fit directly the body in a supply inlet (8') of a jack body (8) on one end of the jack cylinder. Said member (6) is axially provided with a concentric bore allowing the fluid to flow through.

Said bore thus constitutes a conduit (9) provided in the cylindrical member and having at one end (60) of the member an orifice (10) external to the jack, and at the other end (61), an orifice (11) which communicates with the internal volume of the jack.

Said member (6) is also provided at its first end of the conduit (9) with an internal thread (12) and a polygonal external clamping head (13) whereas the second end is constituted by a part extending from the body and provided with an external thread (14); sealing joints (15 and 16) are respectively placed between the head and a first surface (17) supporting the body (2) and between a second surface (18) supporting the body, which is opposite and parallel to (17), and the jack.

Between the second bore (7) and an intermediate portion (19) of the member (6) engaging thereinto, there is an annular space (20) which is connected to the conduit (9) by lateral openings in the member (6) such as (21) opening on to the external surface of the part (19).

Moreover, a conduit (22) in the body connects the second bore (7) to a base (23) of the first bore (3). There can also be no annular space (20) if the openings (21) are directly connected to the conduit (22).

The distributor device (4) comprises a rotary skirt (24) with a first co-axial chamber (25) situated on the bottom (23) side and communicating with a second co-axial chamber (26) by an orifice (27); moreover, the first chamber communicates via a side passage (28) with a first external annular groove (29), whereas the second chamber communicates via a passage (30) with a second external annular groove (31) of the skirt; both these grooves being separated by an external annular rib (32).

A switching member (33), axially movable along XX', and with one end (34) in the first chamber, traverses the orifice (27) to penetrate into the second chamber via a second end (35) supporting a valve (36) adapted to close off and open the orifice (27) when the said switching member (33) is moved towards the left and the right respectively.

Between the bottom (23) and a first frontal wall (37) of the skirt, there is provided an elastic membrane (38) which is sealingly gripped on its periphery, whereas a second frontal wall (39) of the skirt, which is opposite the first one, supports a plug (40) which is placed at the end (41) of the bore (3). Said plug, which supports the pneumatic connector (5) is provided with a conduit (42), one outlet (43) of which is facing the valve, and one inlet (44) of which communicates with the pipe (45), the end of which is engaged in the connector (5).

Because of the skirt being adapted in the bore and because of the use in some cases of sealing joints, not shown, the grooves (29) and (31) are not interconnected; said grooves are separately connected, via respective conduits (46 and 47) situated in the body (2) and issuing into the bore (3), with two external pneumatic connectors (48) and (49) respectively, the openings (50 and 51) of which issue, like those of the connector (5) on to an external surface (52) of the body opposite the second bore to receive the ends of pipes, not shown and comparable to (45), (see also FIG. 2).

The distributor device (4) receives a first feeding pressure (Q) through the pipe (45) engaged in the connector (5); said pressure applying the valve (36) on the orifice (27), a pressurized fluid flows through the orifice (43), the chamber (26), the passage (30) the groove (31) and the conduit (47) to reach the outlet S of the connector (49) and the associated pipe for the use and control of an appropriate pressure-using apparatus.

If a second pressure P of adequate value is created in the conduit (9), said pressure is transmitted to the membrane (38) via the openings (21), the space (20) and the passage (22) representing a control input C for the device (4), and causes a deformation of the said membrane whose movement towards the right pushes back the switching member (33) which member opens the orifice (27) and closes off the orifice (43).

The pressure Q prevailing in the chamber (26) and at the outlet S now causes the flow of the fluid contained in the corresponding pipe through the orifice (27), the first chamber (25), the passage (28), the conduit (46), and the connector (48) which may be directly open to the free air E, or be connected to an exhaust pipe system, not shown.

When this relay is used on a jack (8), a conventional pneumatic fitting (52) can be mounted on its cylindrical part (6) by screwing a hollow fastening member (53) of the fitting, into the threaded portion (12) of the cylindrical member (6), so that a supply of pressurized fluid P destined to the said jack flows through the conduit (54) of the fitting of which a lateral extension (55) is provided with a pneumatic connector (56) connected to a distributor, not shown, via a pipe (57).

It is clear from FIGS. 1 and 2 that the starting directions of all the pipes such as (45) are substantially perpendicular to the axis YY' of the member (6) and that the axes of the connectors (5, 48 and 49) are parallel; the advantage of this particular arrangement is that it allows the orderly grouping and an appropriate orientation of the pipes of the pneumatic relay. In addition, the existence of the baffles created by the openings (21), the space (20) and the passage (22) permits, in combination with a suitable position of the relay with respect to the jack, to prevent any lubricant coming from the jack from depositing close to the membrane and in the passage (22) leading thereto.

In another embodiment (1') of the relay, illustrated in FIGS. 3 and 4, a conduit (54') of axis ZZ', is cut directly in the body (2') to reach a second bore (7') of axis YY' substantially perpendicular; a hollow cylindrical relay-fastening part (6'), similar to the preceding one but closed off at its first end (60') comprises a series of side openings (21') to connect both an inner conduit (9') and the conduit (54') with the one and only annular space (20') provided between (7') and (6') and thus to a control C' passage (22'), leading to a distributor device (4') similar to the preceding one; as illustrated in FIG. 1, the complete supply conduit consisting of the portions (9') and (54') has a large cross-section in order to prevent losses of load and it comprises a first end (58) abutting on the jack (8) and a second end (59) abutting via a pneumatic connector (56') on a pipe (57') supplying pressurized fluid P. Said connector (56') as well as connectors (49', 5' and 48') abut in parallel on to the same side face (52') of the body (2').

The two variants described hereinabove have respectively specific advantages which will cause them to be preferred one over the other depending on the requirements of the user.

If the latter wants to use a pneumatic relay and supply the jack either directly with a supply of pressure P, or via a flow regulator or a unidirectional speed regulator, each one being incorporated in a fitting, he will give preference to the embodiment illustrated in FIG. 1, wherein said fitting can be screwed into the threaded bore (12).

If on the contrary, the user is seeking a better compacity and an integral grouping of the pipes, the embodiment illustrated in FIG. 3 will be a better answer to his needs.

When this relay works as a pressure-dropping pick-up relay associated to the supply of a jack, a pressure Q is applied permanently and the output S is connected to the exhaust E as long as the volume of the cylinder which is gradually reducing is subjected to the pressure of the fluid released by the jack towards the distributor through the auxiliary conduit (9, 54); as soon as the piston of the jack has reached its uttermost stroke and that the said volume has reached its minimum value, the pressure in the said conduit becomes nil and the first pressure Q is connected to the output S to supply an end-of-stroke signal.

When the said relay is associated to a branch-pipe type jack, with a view to indicating when the piston of the jack has reached a certain position corresponding to a connecting orifice placed in a special point of the cylinder, the relay supply inlet receiving the pressure Q is directly connected to the said orifice and therefore is only pressure-fed if the piston has gone beyond said point. As a result, a signal will only be delivered at the output S of the relay if the piston of the jack has not been held back through some accidental jamming before reaching the point in question.

In a variant embodiment of the pressure relay according to FIG. 1, which is shown in FIG. 5, the hollow cylindrical part (6'') is provided at its end (61'') with a conical threading (14'') which can engage in a correspondingly threaded portion (8″) provided in the orifice (8″) of a jack (8‴). Complete tightness between the jack and the cylindrical part is obtained here by adequate clamping with a tool, not shown, which cooperates with faces (13″) placed over a portion of the cylindrical part situated between the pressure relay (2″) and the jack (8‴).

The upper portion (60″) of the said cylindrical part therefore has no means of cooperation with any clamping tool, this permitting to produce the said part (6″) with thinner walls and from a metal with a lower mechanical strength than in the preceding case. The fact that in this particular arrangement, the body of the relay is not gripped between the jack and the upper portion (60″) makes it necessary to provide different sealing means from those used in the preceding example; the intermediate portion (19″) here comprises two O-rings (15″ and 16″) placed axially on either sides of openings (21″) and which cooperate with the cylindrical surface of the second bore (7″). In this case, the cylindrical part (6″) is held in axial position inside the body of the relay on the one hand by the first upper end (60″), wider than the second bore and on the other hand by a circlip (62) placed around the part (7″) and under the lower surface (18″) of the body.

As in the preceding example, the cylindrical part (6″) has an axial conduit (9″) which communicates with the side orifices (21″); however, the upper end of the said conduit here comprises a conical thread (12″) capable of receiving a fitting (51″).

What is claimed is:

1. In combination, a jack and a pneumatic pressure relay the jack having a fluid receiving housing, and having a fluid inlet and having a member therein movable in response to the fluid in a chamber defined by the member and the walls of the housing, said relay comprising:

a body with an auxiliary conduit therethrough, with first means on said body at one end of said conduit connecting said one end of said conduit to said fluid inlet of said housing and securing said body to said jack, said conduit extending from said fluid inlet to a portion of said body spaced from said fluid receiving housing thereby permitting access to the other end of said conduit from externally of said housing when the body is secured to said housing, second means on said body at said other end of said conduit for connecting said conduit to a source of supply of operating fluid under pressure for said housing for operating said member, said conduit having a cross-sectional size which is substantially equal to the cross-sectional size of said fluid inlet to permit the operating fluid for said member to flow through said conduit into said housing without substantial pressure loss, and said body having a chamber therein with an exhaust outlet and a signal outlet and having a control opening extending from said conduit to said chamber for fluid flow from said conduit to said chamber;

dividing means dividing said chamber into a first sub-chamber and a second sub-chamber and having an opening therein, said dividing means preventing the flow of fluid between said first sub-chamber and said second sub-chamber except through said opening of said dividing means, said first sub-chamber being adjacent said control opening for receiving fluid therefrom and being connected for fluid flow to said exhaust outlet and said second sub-chamber being connected for fluid flow to said signal outlet;

an elastic membrane intermediate said control opening and at least a portion of said first sub-chamber, said membrane being in fluid-tight relation with the wall of said first sub-chamber and being movable by fluid in said control opening away from the latter;

fluid feeding means on said body for supplying fluid to said second sub-chamber, said feeding means being spaced from said fluid receiving housing thereby permitting access thereto from externally of said housing when said body is secured to said housing and having an opening at said second sub-chamber for supplying a fluid to said second sub-chamber;

valve means in said chamber for alternately preventing fluid flow through said opening in said dividing means while permitting fluid flow through said opening in said feeding means and permitting fluid flow through said opening in said dividing means while preventing fluid flow through said opening in said feeding means for thereby interconnecting, in a first position thereof, said first sub-chamber and said second sub-chamber for fluid flow therebetween and preventing fluid flow from said feeding means into said second sub-chamber and for alternately, in a second position thereof, preventing fluid flow between said first sub-chamber and said second sub-chamber and permitting fluid flow from feeding means into said second sub-chamber, said valve means being movable from said second position thereof to said first position thereof by fluid supplied by said feeding means and having operating means adjacent said membrane for moving said valve means from said position thereof to said first position thereof upon movement of said membrane away from said control opening by fluid flowing through said control opening.

2. A jack and a pneumatic pressure relay as set forth in claim 1, wherein said auxiliary conduit has a rotatable, hollow member therein, said rotatable hollow member having at least one opening therein permitting fluid flow between the interior of said last-mentioned member and said auxiliary conduit.

3. A jack and a pneumatic pressure relay as set forth in claim 2 wherein a portion of said rotatable, hollow member extends from said body, said means on said body at one end of said conduit connecting said conduit to said fluid inlet of said housing comprises threads on said portion of said rotatable, hollow member and said means on said body at the other end of said conduit for connecting said conduit to a source of supply of fluids for said housing comprises threads on the wall of said conduit at said other end thereof.

4. A jack and a pneumatic pressure relay as set forth in claim 2 wherein said rotatable, hollow member has at least one further opening therein permitting fluid flow between the interior of said last-mentioned member and said control opening.

5. A jack and a pneumatic pressure relay as set forth in claim 2 wherein a first portion of said rotatable, hollow member at one end thereof extends from said body and a second portion of said rotatable, hollow member at the other end thereof extends from said body, said means on said body at one end of said conduit comprises threads on said first portion of said rotatable, hollow member and said means on said body at the other end of said conduit comprises threads on said second portion of said rotatable, hollow member.

6. A jack and a pneumatic pressure relay as set forth in claim 5, wherein said second portion of said rotatable hollow member has an exterior surface portion which is non-circular with respect to the axis of rotation of said last-mentioned member.

7. A jack and a pneumatic pressure relay as set forth in claim 2 wherein said auxiliary conduit comprises first and second communicating portions which extend perpendicular to each other, wherein said rotatable, hollow member is rotatably mounted in the first of said portions and has a threaded portion which extends out of the first of said portions and which forms said first-mentioned means and wherein said opening in said rotatable hollow member communicates for fluid flow with the second of said communicating portions.

8. A jack and a pneumatic pressure relay as set forth in claim 1 wherein said auxiliary conduit has a first opening at one end thereof which faces in a first direction and a second opening at its said other end which faces in a second direction perpendicular to said first direction and wherein said exhaust outlet also faces in said second direction.

9. A jack and a pneumatic pressure relay as set forth in claim 1 wherein the axis of said chamber extends perpendicularly to an axis of at least a portion of said auxiliary conduit.

10. A jack and a pneumatic pressure relay as set forth in claim 1 further comprising a skirt in said chamber engaging and pressing said elastic membrane against said wall of said first sub-chamber and a plug forming one wall of said chamber and maintaining said skirt in place.

11. In the combination of a jack and a pneumatic pressure relay, said jack having a fluid receiving housing, having a fluid inlet and having a member therein movable in response to the fluid in a chamber defined by the member and the walls of the housing, and said relay comprising a body which is secured to said housing, said body having an exhaust outlet and a signal outlet, a chamber with means dividing said chamber into a first sub-chamber and a second sub-chamber, means connecting said first sub-chamber to said exhaust outlet, means connecting said first sub-chamber to the fluid supplied to said fluid inlet, means connecting said second sub-chamber to said signal outlet, fluid feeding means for supplying fluid to said second sub-chamber and valve means responsive to the pressure of the fluid at said fluid inlet and of the fluid supplied to said second sub-chamber for alternately preventing fluid flow between said first sub-chamber and said second sub-chamber while permitting fluid flow from said fluid feeding means into said second sub-chamber and permitting fluid flow between said first sub-chamber and said second sub-chamber while preventing fluid flow from said fluid feeding means into second sub-chamber, the improvement wherein:

said body has an auxiliary conduit of substantially the same cross-sectional size as said fluid inlet of said housing, has first means at one end of said conduit connecting said one end of said conduit to said fluid inlet of said housing and securing said body to said jack, said conduit extending from said fluid inlet to a portion of said body spaced from said fluid receiving housing thereby permitting access to the other end of said conduit from externally of said housing when the body is secured to said housing, and has second means at said other end of said conduit for connecting said conduit to a source of supply of operating fluid under pressure for said housing for operating said member; and said means connecting said first sub-chamber to the fluid supplied to said fluid inlet is fluid conveying means extending through a wall of said conduit to said first sub-chamber.

12. A jack and pneumatic pressure relay combination as set forth in claim 11 wherein said first sub-chamber is adjacent said conduit and said fluid conveying means are openings in the wall of said conduit and a wall of said first sub-chamber.

* * * * *